US011352824B2

(12) United States Patent
Matsushita

(10) Patent No.: US 11,352,824 B2
(45) Date of Patent: Jun. 7, 2022

(54) CABLE GUIDE ASSEMBLY FOR A WINDOW REGULATOR

(71) Applicant: HI-LEX CONTROLS, INC., Rochester Hills, MI (US)

(72) Inventor: Masayuki Matsushita, Rochester Hills, MI (US)

(73) Assignee: HI-LEX CONTROLS, INC., Rochester Hills, MI (US)

( * ) Notice: Subject to any disclaimer, the term of this patent is extended or adjusted under 35 U.S.C. 154(b) by 230 days.

(21) Appl. No.: 16/884,635

(22) Filed: May 27, 2020

(65) Prior Publication Data

US 2021/0372188 A1 Dec. 2, 2021

(51) Int. Cl.
*E05F 11/48* (2006.01)
*E05F 11/06* (2006.01)

(52) U.S. Cl.
CPC ..... *E05F 11/485* (2013.01); *E05F 11/06* (2013.01); *E05Y 2201/654* (2013.01); *E05Y 2201/66* (2013.01); *E05Y 2201/668* (2013.01); *E05Y 2201/672* (2013.01); *E05Y 2900/55* (2013.01)

(58) Field of Classification Search
CPC ..... E05F 11/485; E05F 11/06; E05F 11/488; E05F 15/689; E05Y 2201/654; E05Y 2201/66; E05Y 2201/668; E05Y 2201/672; E05Y 2201/638; E05Y 2201/684; E05Y 2900/55
USPC ..... 49/352
See application file for complete search history.

(56) References Cited

U.S. PATENT DOCUMENTS 4,781,665 A 11/1988 Walker
5,081,792 A * 1/1992 Huebner ..... E05F 11/525 49/375
5,657,580 A * 8/1997 Kobrehel ..... E05F 11/485 49/352
5,778,600 A * 7/1998 Chu ..... E05F 11/485 49/352
6,584,731 B2 7/2003 Arquevaux et al.
7,958,676 B2 * 6/2011 Kruger ..... E05F 11/483 49/352
8,402,694 B2 * 3/2013 Daumal Castellon ..... E05F 11/481 74/505
9,151,102 B2 * 10/2015 Debus ..... E05F 7/00
(Continued)

FOREIGN PATENT DOCUMENTS

EP 2594165 A1 5/2013
KR 100801491 B1 2/2008
WO 9500734 A1 1/1995

*Primary Examiner* — Jerry E Redman
(74) *Attorney, Agent, or Firm* — Dickinson Wright PLLC

(57) ABSTRACT

A cable guide assembly adapted for use with a guide rail for a motor vehicle, for redirecting a cable of a window regulator, includes a cable guide formed with an outer perimeter and a cable guide receiving site formed in the guide rail adapted to receive and mount the cable guide. The cable guide includes a cable guide groove to guide the cable wrapping around the cable guide and a generally circular interior cavity to mount to the guide rail. In the cable guide assembly, the cable guide is securely engaged with a center support in the cable guide receiving site and rotatable between two rotatable positions, a temporary holding position and a final position. In the temporary holding position, the cable is at a first tension and the cable is at a second tension higher than the first tension in the final position.

12 Claims, 6 Drawing Sheets

(56) References Cited

U.S. PATENT DOCUMENTS

| | | | | |
|---|---|---|---|---|
| 2002/0139051 | A1* | 10/2002 | Arquevaux | E05F 11/485<br>49/352 |
| 2004/0187389 | A1* | 9/2004 | Santaolalla Gil | E05F 11/486<br>49/352 |
| 2006/0174542 | A1* | 8/2006 | Bernard | E05F 11/485<br>49/352 |
| 2007/0251148 | A1 | 11/2007 | Watson et al. | |
| 2010/0258664 | A1 | 10/2010 | Twork | |

* cited by examiner

CABLE GUIDE ASSEMBLY FOR A WINDOW REGULATOR

TECHNICAL FIELD

This present disclosure relates to a cable guide assembly for a window regulator potentially suited for various application but in a preferred implementation is utilized in an automotive window regulator assembly.

BACKGROUND

The statements in this section merely provide background information related to the present disclosure and may not constitute prior art.

Motor vehicles such as a passenger car and a light truck feature a movable glass in each side door. The mechanism of the movable glass is required to move the glass between the upper closed position and the lower opened position. These mechanisms are generally known as window regulators. Window regulators can be manually operated, or can be driven by a power actuator, most commonly employing an electric motor. One type of window regulator uses pulley assemblies and/or cable guides redirecting a metal cable wrapped around a drum driven by an electric motor. These devices use carriers movable along guide rails which engage the door glass which is a driven by the metal cable to control its motion.

The cable guides and/or pulley assemblies provided for cable driven window regulator systems are available in numerous configurations. Generally, the pulley assemblies attached or coupled to the guide rail on a module plate are provided to rotate about an axis of rotation for changing a direction of the metal cable. Various fastening elements such as screws or stepped pins are used for rotatable attachments, which are guided centrally through the cable pulley assemblies.

As described above, the fastening elements such as the stepped pins and washers are used for supporting forces on the cable pulley. We have discovered, however, that the pulley assemblies or cable guides having the fastening elements will take more manufacturing steps for the assembly of the window regulator. Accordingly, there is constantly a desire to simplify the assembled components and steps of the pulley assemblies or cable guides. In addition, there is more desire to reduce cost and weight of automotive components, while providing a desirable durability, low warranty claims, and compliance with performance requirements.

SUMMARY

The present disclosure relates to a cable guide assembly utilized in an automotive window regulator assembly. In particular, the present disclosure relates to the cable guide fixedly mounted to a guide rail generally attached to the integrated door module plate.

According to an aspect of the present disclosure, the cable guide assembly adapted for use with a guide rail for a motor vehicle, for redirecting a cable of a window regulator includes a cable guide formed with an outer perimeter having a cable guide groove and a generally circular interior cavity and mounted to the guide rail, and a cable guide receiving site formed in the guide rail adapted to receive and mount the cable guide. Furthermore, the cable guide includes a locating recess and a temporary holding recess, and the cable guide receiving site includes a cable guide locating protrusion and a center support protruding from the guide rail for mounting the cable guide. The cable guide is securely engaged with the center support in the cable guide receiving site and rotatable between two rotated positions, a temporary holding position and a final position. In the temporary holding position, the temporary holding recess of the cable guide is engaged with the cable guide locating protrusion of the cable guide receiving site, and in the final position, the locating recess of the cable guide is engaged with the cable guide locating protrusion of the cable guide receiving site. Furthermore, the cable is guided by the perimeter groove and when the cable guide is in the temporary holding position, the cable is at a first tension and the cable is at a second tension higher than the first tension in the final position.

According to a further aspect of the present disclosure, the circular interior cavity of the cable guide is configured to couple with the center support of the cable guide receiving site such that the cable guide is formed as a ring shape having a varied radial wall thickness. The circular interior cavity of the cable guide is formed as an eccentric oval hole shape.

According to a further aspect of the present disclosure, the outer perimeter of the cable guide includes a top flange and a bottom flange and the perimeter groove is formed between the top and bottom flanges.

According to a further aspect of the present disclosure, the cable guide includes a first tab and a second tab formed on the top flanges, and the first tab is formed at a location having a smallest radial wall thickness and the second tab is formed at an opposite location from the first tab.

According to a further aspect of the present disclosure, the locating recess and the temporary holding recess are formed on the bottom flanges of the cable guide, and both recesses are formed at an opposite location from each other. A locating projection is formed on an inner circumferential surface of the cable guide and adjacent to the temporary holding recess on the bottom flange.

According to a further aspect of the present disclosure, the cable guide receiving site includes a cable guide retention tab formed on a top location of the center support for retaining the cable guide at the temporary holding and final positions of the cable guide. A center support recess is formed at a location below the cable guide retention tab for receiving a locating projection of the cable guide in the final position such that the cable guide is securely engaged with the center support of the cable guide receiving site.

According to a further aspect of the present disclosure, the cable guide locating protrusion is formed on a plane surface of the cable guide receiving site and positioned at a separated location from the center support.

According to a further aspect of the present disclosure, a cable retention tab is formed on the cable guide receiving site for retaining the cable at the final position of the cable guide.

According to a further aspect of the present disclosure, the cable guide is securely coupled to the cable guide receiving site in the final position by manually rotating the cable guide with the first and second tabs in the temporary holding position.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
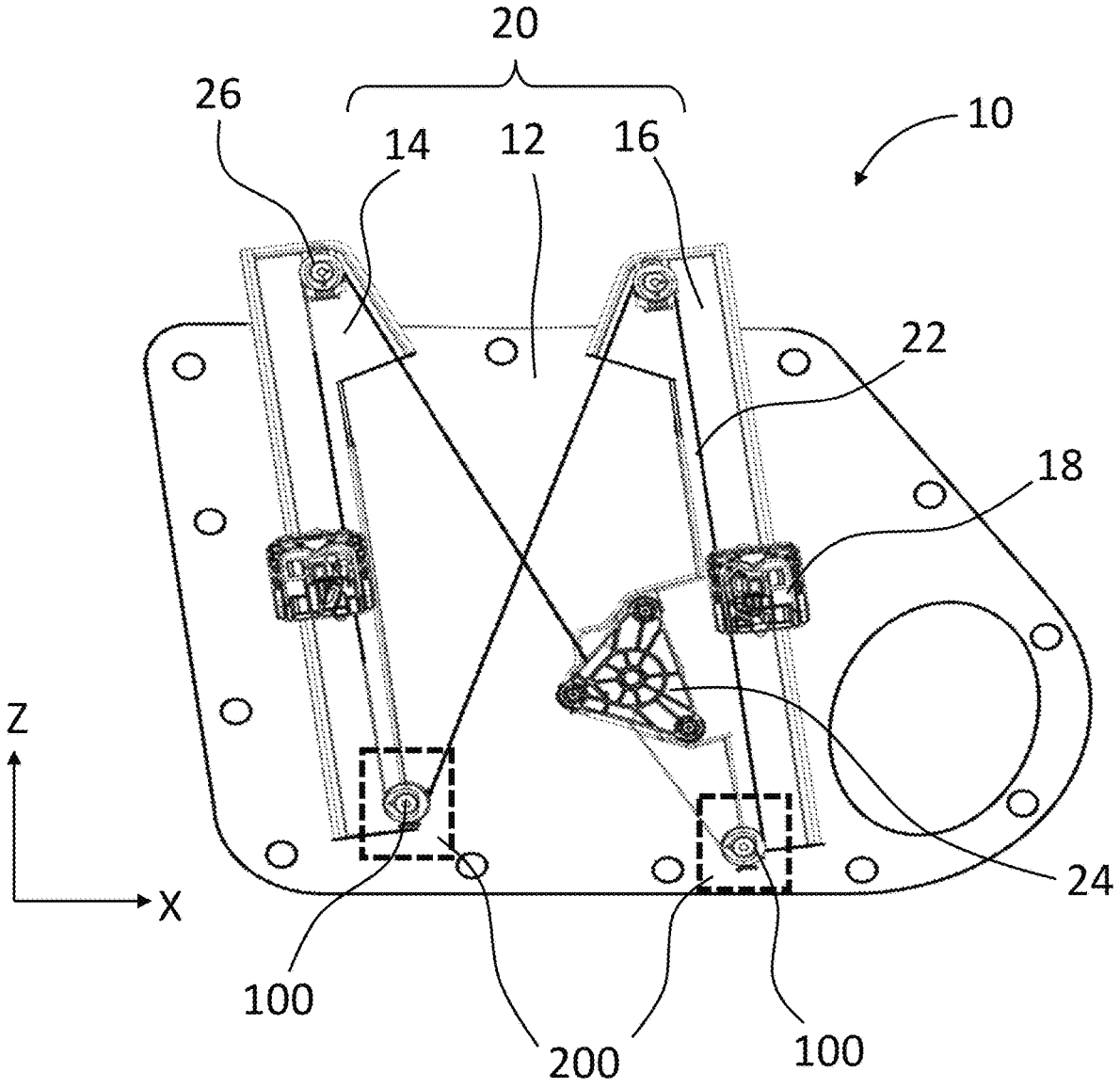
FIG. 1 is a plan view of a cable guide assembly in a window regulator assembly in accordance with an embodiment of the present invention.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 illustrates a window regulator assembly 10 in a motor vehicle. The window regulator assembly 10 generally includes a door module plate 12, and first and second guide rails 14 and 16, which are oriented parallel to each other. On the window regulator assembly 10, both guide rails 14 and 16 extend from a lower end to an upper end slightly inclined with respect to a vertical axis Z, i.e., in the assembled condition, both guide rails 14 and 16 are slightly inclined relative to the vertical axis Z, defined as a line point from the bottom of the vehicle to the top of the vehicle. In addition, the guide rails 14 and 16 extend and hang over a top edge of the door module plate 12 as shown in FIG. 1.

In FIG. 1, the first and second guide rails 14 and 16 are used as a guide for the movement of a window between an open position and a closed position. Both guide rails 14 and 16 are generally separately attached to the door module plate 12 as found in a conventional window regulator assembly. As shown in FIG. 1, in another approach, the first and second guide rails 14 and 16 are preferably integrally formed together with the door module plate 12 as a single unit such that an integrated door module plate 20 formed with the first and second guide rails 14 and 16 is made from a thermoplastic material in order to reduce its weight, and to simplify integration with and provide support for other components in the window regulator assembly 10.

The window regulator assembly 10 further includes window carriers 18, a cable 22, and a driving unit 24. Each of the window carriers 18 is engaged with each of the first and second guide rails 14 and 16, and caused to travel up and down along the guide rails 14 and 16. In addition, the window carriers 18 include a window clamp arrangement (not shown) which is engaged with a window. Each of the window carriers 18 is attached or connected to the cable 22, and such arrangements or connections may be made by clamps, fasteners, adhesives, press-fitting, snap-fitting, or any other means.

In FIG. 1, the drive unit 24 is manually operated via a hand crank mechanism or powered, most commonly done using an electric motor attached to a set of gears, such as worm and spur gears (not shown). The drive unit 24 interacts with the cable 22 to provide the cable tension necessary to cause the window carriers 18 and the window (not shown) to move between its open and closed positions. Furthermore, the drive unit 24 is attached to the integrated door module plate 20.

Referring to FIG. 1, each of the guide rails 14 and 16 includes pulley assemblies 26 coupled to the upper end of the guide rails 14 and 16. In addition, cable guides 100 are engaged with the lower end of the guide rails 14 and 16. For example, as shown in FIG. 1, at least two cable guides 100 are coupled to the guide rails 14 and 16 in the integrated door module plate 20 for guiding the cable 22. In FIG. 1, the guide rails 14 and 16 in the integrated door module plate 20 are formed with at least two cable guide receiving sites 200 each receiving the cable guides 100 respectively. The pulley assemblies 26 and cable guides 100 in the window regulator assembly 10 serve as redirecting elements for the cable 22 such that a driving force transmitted via the cable 22 is redirected via the pulley assemblies 26 and the cable guides 100. The pulley assemblies 26 mounted to the integrated door module plate 20 are freely rotated during the operation of the window regulator assembly 10, but according to the present disclosure, the cable guides 100 mounted to the guide rails 14 and 16 of the integrated door module plate 20 are fixed and not rotated during the operation of the window regulator assembly 10. Accordingly, the window engaged with the window carriers 18 are operated, i.e., raised and lowered by the window regulator assembly 10.

Figure 2A:
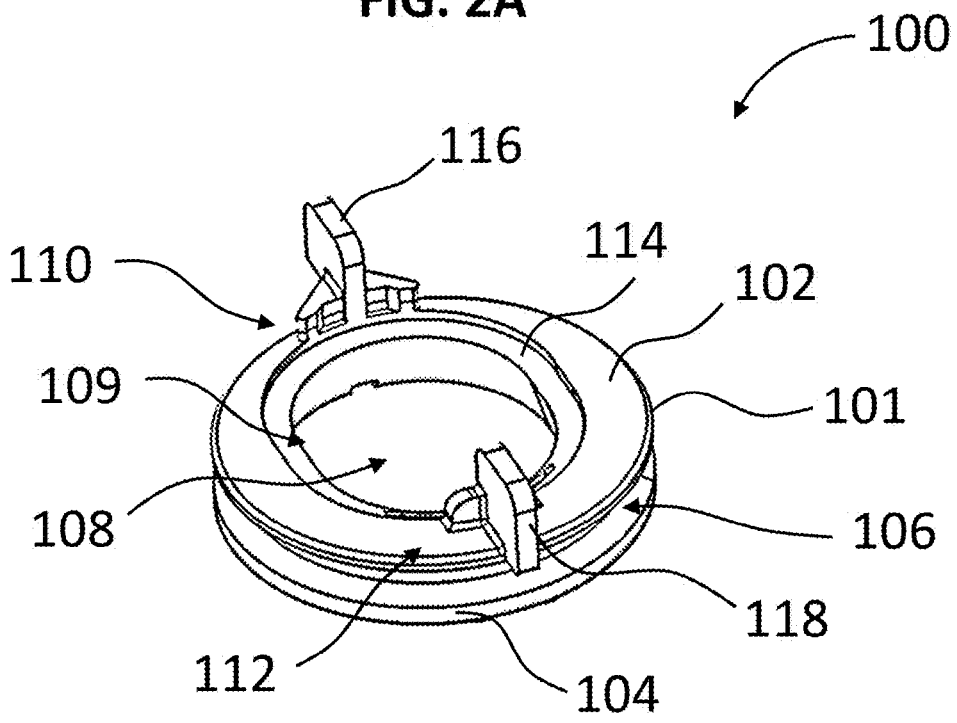
FIG. 2A shows a plan view of a top flange in a cable guide of FIG. 1.
Figure 2B:
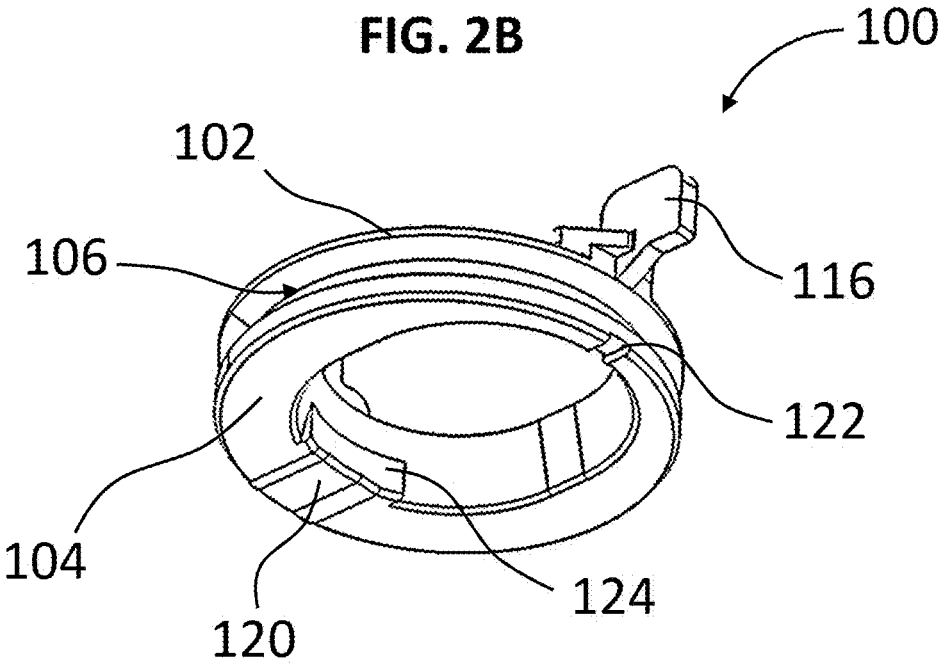
FIG. 2B shows a plan view of a bottom flange in the cable guide of FIG. 1.

FIGS. 2A and 2B illustrate the cable guide 100 for redirecting the cable 22 in the window regulator assembly 10. The cable guide 100 is generally formed with an outer perimeter 101 having a cable guide groove 106 and a generally circular interior cavity 108. For example, as shown in FIGS. 2A and 2B, the outer perimeter 101 of the cable guide 100 is formed with a circular shape, and includes a top flange 102 and a bottom flange 104 such that the cable guide groove 106 is formed between the top and bottom flanges 102 and 104. According to other forms of the present disclosure, the outer perimeter 101 of the cable guide 100 may be formed with different outer shapes such as an elliptical shape for redirecting the cable 22. In FIGS. 2A and 2B, the cable guide 100 is configured to guide the cable 22 inside the cable guide groove 106 for redirecting the cable 22 such that the cable 22 wraps around the cable guide 100 and smoothly travels inside the groove 106 of the cable guide 100 during the operation of the window regulator assembly 10.

As shown in FIGS. 2A and 2B, the cable guide 100 includes the circular interior cavity 108 for mounting to the cable guide receiving site 200 and further includes a rim having different sizes around the outer perimeter 101 of the cable guide 100. For example, in FIGS. 2A and 2B, the circular interior cavity 108 of the cable guide 100 is formed with an eccentric oval hole 109. In FIGS. 2A and 2B, accordingly, a first rim 110 and a second rim 112 are defined in the cable guide 100 formed with the eccentric oval hole 109 such that the first rim 110 is located at an area having the smallest thickness between the inner edge and the outer edge of the cable guide 100 and the second rim 112 is located at another area having the largest thickness between the inner edge and the outer edge of the cable guide 100.

In FIG. 2A, the cable guide 100 includes a first tab 116 located at the first rim 110 and a second tab 118 located at the second rim 112 on the surface of the top flange 102. In FIG. 2B, the cable guide 100 further includes a temporary holding recess 120 and a locating recess 122 for mounting to the cable guide receiving site 200. The temporary holding recess 120 is formed at the second rim 112 on the surface of the bottom flange 104 and the locating recess 122 is formed at the first rim 110 on the surface of the bottom flange 104. As shown in FIG. 2B, furthermore, a locating projection 124 is formed to protrude from an inner circumference surface of the cable guide 100.

Figure 3:
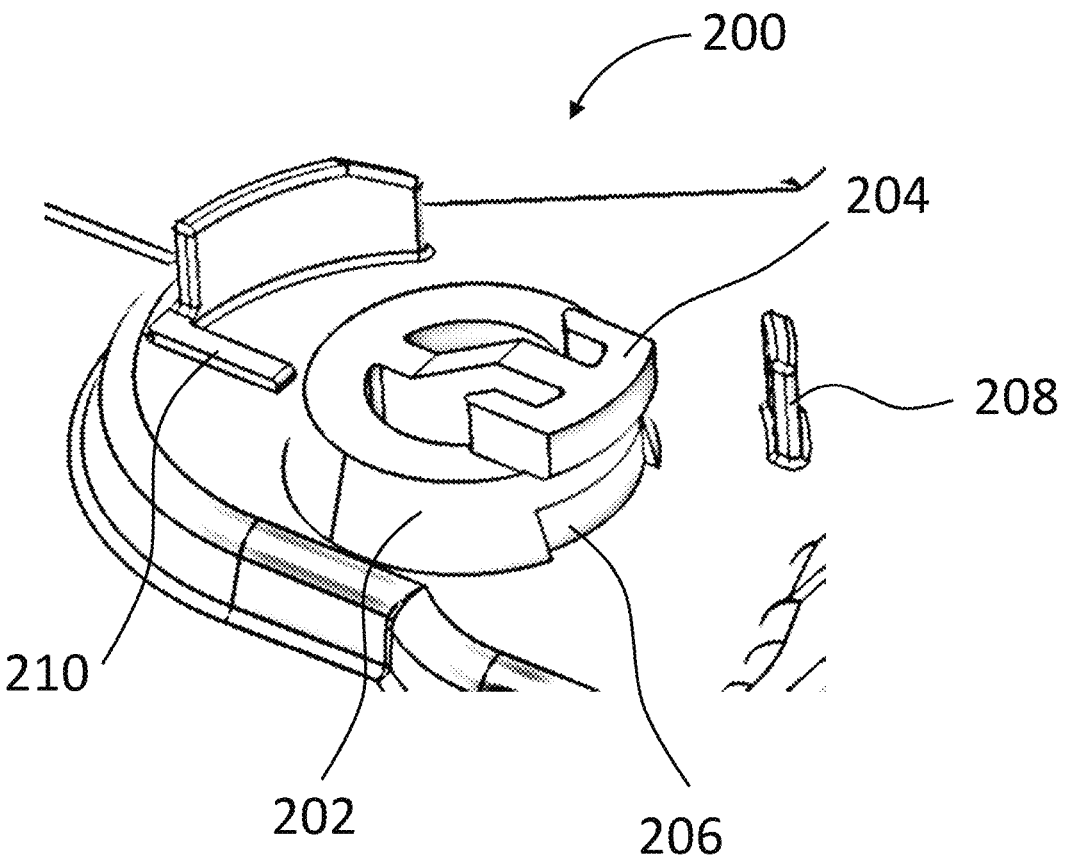
FIG. 3 shows a plan view of a cable guide receiving site of a guide rail formed in an integrated door module plate of FIG. 1.

FIG. 3 illustrates the cable guide receiving site 200 on one of the guide rails 14 and 16 in the integrated door module plate 20 for mounting the cable guide 100. The cable guide receiving site 200 includes a center support 202 for engaging with the circular interior cavity 108 of the cable guide 100. The center support 202 of the cable guide receiving site 200 includes a cable guide retention tab 204 for retaining the cable guide 100 by engaging with the cable guide 100 and a cable guide locating recess 206 located adjacent to the cable guide retention tab 204. The cable guide locating recess 206 of the center support 202 is configured to receive the locating projection 124 of the cable guide 100 for coupling with the cable guide 100. Accordingly, the cable guide 100 is securely engaged with the center support 202 in the cable receiving site 200 and rotatable between two rotated positions—a temporary holding position and a final position such that the cable guide 100 is rotatably mounted to the cable guide receiving site 200. The first and second tabs 116 and 118 are used to rotate the cable guide 100 by hand (manually). However, the cable guide 100 may be rotated by other means in accordance with other forms of the present disclosure. Furthermore, a stepped-down surface 114 formed around the circular interior cavity 108 of the cable guide 100 allows the cable guide 100 to rotate without interfering with the cable guide retention tab 204 of the center support 202 when the cable guide 100 is rotatably moved to the final position from the temporary holding position.

As shown in FIG. 3, the cable guide receiving site 200 further includes a cable retention tab 208 for retaining and guiding the cable 22 when the cable guide 100 is mounted to the cable guide receiving site 200 in the final position. The cable retention tab 208 is configured to retain the cable 22 wrapped around the cable guide groove 106. In addition, the cable guide receiving site 200 includes a cable guide locating protrusion 210 engaging the temporary holding recess 120 of the cable guide 100 in the temporary holding position and also engaging the locating recess 122 of the cable guide 100 in the final position. Accordingly, the cable guide 100 is securely mounted to the guide rail 14 of the integrated door module plate 20 in the final position.

Figure 4A:
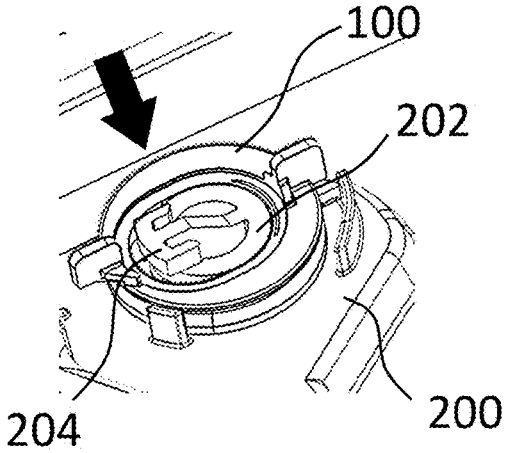
FIGS. 4A through 4F show a process of the cable guide assembly of FIG. 1.
Figure 4B:
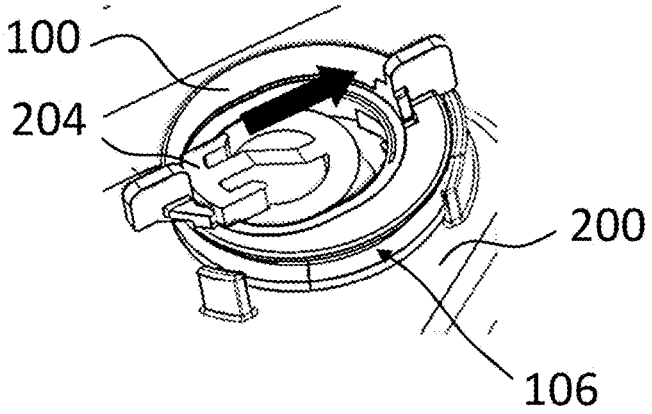

FIGS. 4A through 4F illustrate an assembly process of the cable guide 100 with one of the guide rails 14 and 16 in the integrated door module plate 20 in the window regulator assembly 10. In particular, FIGS. 4A through 4F show the cable guide 100 mounting to the cable guide receiving site 200 of the integrated door module plate 20. In FIG. 4A, the cable guide 100 is placed in the center support 202 of the cable guide receiving site 200 of the integrated door module plate 20. During the step of FIG. 4A, the cable guide 100 is movable due to the circular interior cavity 108 having a bigger cavity size than a general diametric size of the center support 202. In FIG. 4B, after placing the cable guide 100 in the cable guide receiving site 200, the cable guide 100 is moved for coupling to the cable guide retention tab 204 such that the cable guide 100 is temporarily retained in a position defined as a temporary holding position of the cable guide 100. In the temporary holding position of the cable guide 100, the temporary holding recess 120 of the cable guide 100 is engaged with the cable guide locating protrusion 210 on the guide rail 14 in the integrated module plate 20, and the cable guide retention tab 204 is configured to temporarily retain the cable guide 100.

Figure 4C:
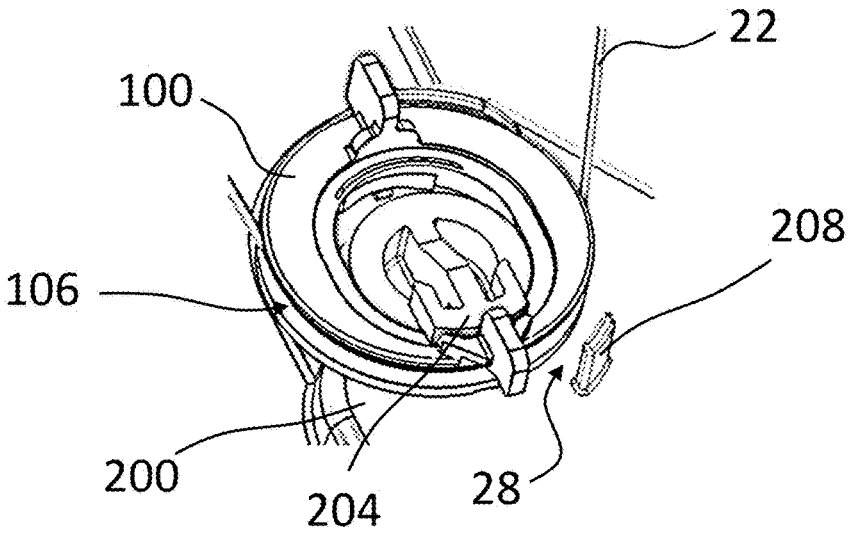
Figure 4D:
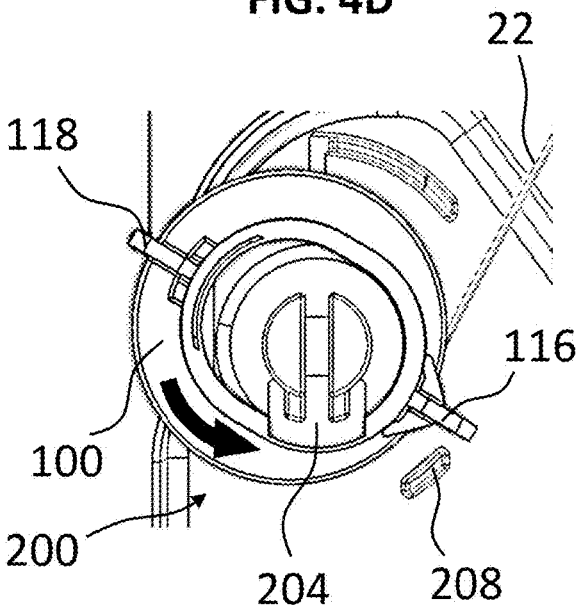
Figure 4E:
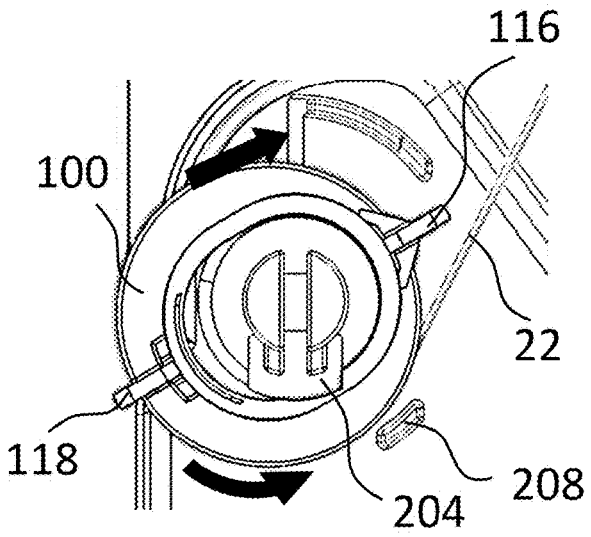

In the window regulator assembly 10 of FIGS. 1 and 4C, the cable 22 wraps around the pulley assembly 26 and the cable guide 100 in the window regulator assembly 10. When the cable 22 is wrapped around the cable guide 100 in the temporary holding position, the cable 22 is placed inside the groove 106 of the cable guide 100 through a space 28 (or gap) between the outer edge on the outer perimeter 101 of the cable guide 100 and the cable retention tab 208 formed in the guide rail of the integrated door module plate 20 as shown in FIG. 4C. In the temporary holding position, accordingly, the cable 22 wraps around the cable guide 100 with a first tension. In FIGS. 4D and 4E, the cable guide 100 is rotated while the cable guide 100 is rotatably held by the cable guide retention tab 204. As shown in FIGS. 4D and 4E, when the cable guide 100 is rotated, the temporary holding recess 120 of the cable guide 100 is disengaged from the cable guide locating protrusion 210 on the guide rail of the integrated door module plate 20. In addition, due to the first tension of the cable 22 installed in the window regulator assembly 10, the cable guide 100 slides at certain angle and is also rotated toward the final position.

Figure 4F:
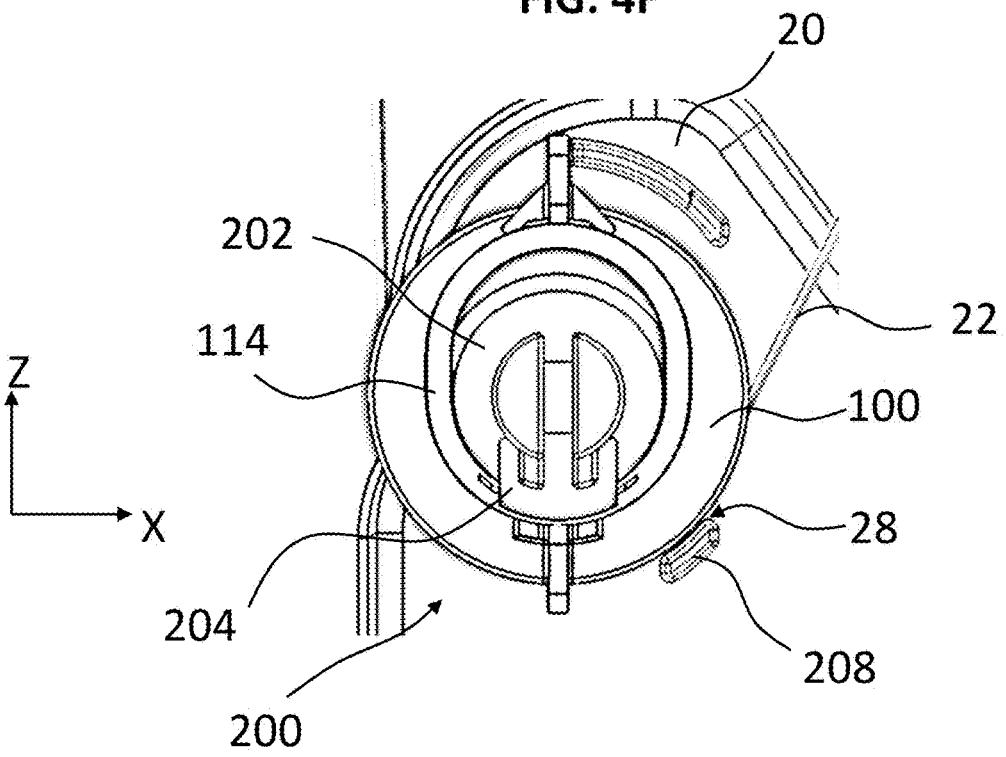
Figure 5:
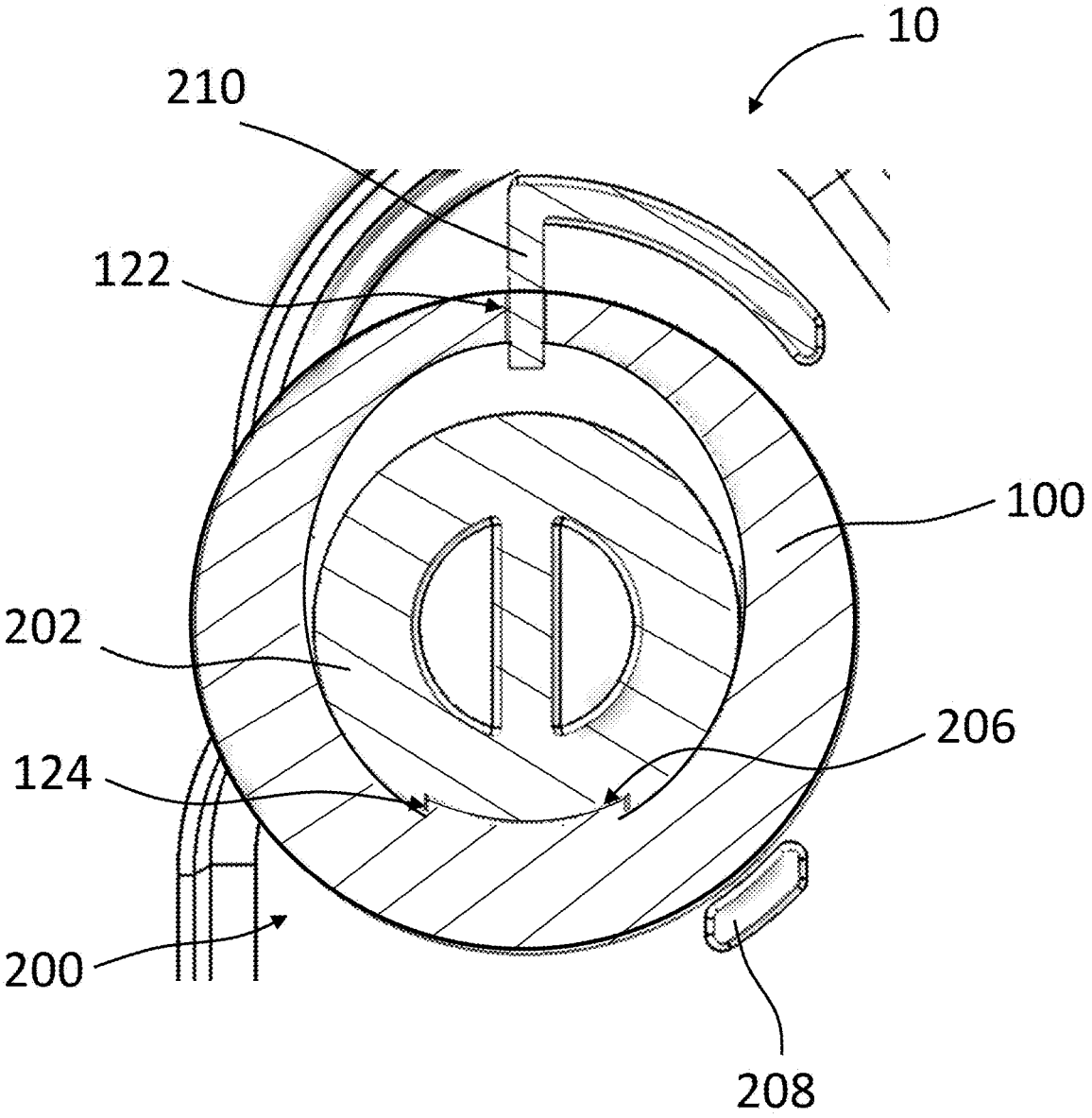
FIG. 5 is a cross-sectional view of the cable guide assembly in a final position of the cable guide of FIG. 4F, taken along XZ-plane of FIG. 4F.

In FIG. 4F, the cable guide 100 is rotatably engaged with the cable guide receiving site 200 such that the cable guide 100 is securely mounted to the guide rail of the integrated door module plate 20 in the final position. In the final position of the cable guide 100, the cable guide retention tab 204 is configured to retain the cable guide 100 by interacting with the stepped-down surface 114 of the cable guide 100. In FIG. 5, the locating recess 122 of the cable guide 100 is engaged with the cable guide locating protrusion 210 on the guide rail of the integrated door module plate 20, and the locating projection 124 of the cable guide 100 is also engaged with the cable guide locating recess 206 formed with the center support 202 of the cable guide receiving site 200. Accordingly, the cable guide 100 is securely mounted to the guide rail of the integrated module plate 20 in the final position. In addition, as shown in FIG. 4F, the cable 22 wrapped around the cable guide 100 is retained in the final position of the cable guide 100 with a second tension, which is higher than the first tension of the cable 22 in the temporary holding position such that the cable 22 is securely retained and guided by the cable guide 100. In the final position of the cable guide 100, the cable 22 is at the second tension and the space 28 (or gap) between the outer edge of the cable guide 100 and the cable retention tab 208 formed on the guide rail of the integrated door module plate 20 is reduced to prevent the cable 22 from coming out of the cable guide groove 106. In the final position, accordingly, the cable guide 100 is securely mounted to the guide rail of the integrated door module plate 20 and the cable 22 wrapped around the cable guide 100 is guided and traveled inside the groove 106 of the cable guide 100.

While the above description constitutes the preferred embodiments of the present invention, it will be appreciated that the invention is susceptible to modification, variation and change without departing from the proper scope and fair meaning of the accompanying claims.

What is claimed is:

1. A cable guide assembly adapted for use with a guide rail for a motor vehicle, for redirecting a cable of a window regulator, the cable guide assembly comprising:

a cable guide formed with an outer perimeter having a cable guide groove and a generally circular interior cavity and mounted to the guide rail, the cable guide including a locating recess and a temporary holding recess; and a cable guide receiving site formed in the guide rail adapted to receive and mount the cable guide, the cable guide receiving site including a cable guide locating protrusion and a center support protruding from the guide rail for mounting the cable guide, wherein the cable guide is securely engaged with the center support in the cable guide receiving site and rotatable between two rotated positions, a temporary holding position and a final position, in the temporary holding position, the temporary holding recess of the cable guide is engaged with the cable guide locating protrusion of the cable guide receiving site, and in the final position, the locating recess of the cable guide is engaged with the cable guide locating protrusion of the cable guide receiving site, and wherein the cable is guided by the perimeter of the cable guide groove and when the cable guide is in the temporary holding position, the cable is at a first tension and the cable is at a second tension higher than the first tension in the final position.

2. The cable guide assembly of claim 1, wherein the circular interior cavity of the cable guide is configured to couple with the center support of the cable guide receiving site such that the cable guide is formed as a ring shape having a varied radial wall thickness.

3. The cable guide assembly of claim 2, wherein the circular interior cavity of the cable guide is formed as an eccentric oval hole shape.

4. The cable guide assembly of claim 2, wherein the outer perimeter of the cable guide includes a top flange and a bottom flange, and the perimeter of the cable guide groove is formed between the top and bottom flanges.

5. The cable guide assembly of claim 4, wherein the cable guide includes a first tab and a second tab formed on the top flange, and the first tab is formed at a location having a smallest radial wall thickness and the second tab is formed at an opposite location from the first tab.

6. The cable guide assembly of claim 4, wherein the locating recess and the temporary holding recess are formed on the bottom flange of the cable guide, and both recesses are formed at an opposite location from each other.

7. The cable guide assembly of claim 4, wherein a locating projection is formed on an inner circumferential surface of the cable guide and adjacent to the temporary holding recess on the bottom flange.

8. The cable guide assembly of claim 1, wherein the cable guide receiving site includes a cable guide retention tab formed on a top location of the center support for retaining the cable guide at the temporary holding and final positions of the cable guide.

9. The cable guide assembly of claim 8, wherein a center support recess is formed at a location below the cable guide retention tab for receiving a locating projection of the cable guide in the final position such that the cable guide is securely engaged with the center support of the cable guide receiving site.

10. The cable guide assembly of claim 1, wherein the cable guide locating protrusion is formed on a plane surface of the cable guide receiving site and positioned at a separated location from the center support.

11. The cable guide assembly of claim 1, wherein a cable retention tab is formed on the cable guide receiving site for retaining the cable at the final position of the cable guide.

12. The cable guide assembly of claim 1, wherein the cable guide is securely mounted to the cable guide receiving site in the final position by manually rotating the cable guide with the first tab and the second tab in the temporary holding position.

* * * * *